US005504944A

United States Patent [19]

Bromer et al.

[11] Patent Number: 5,504,944

[45] Date of Patent: Apr. 9, 1996

[54] COAT SLEEVE CUFF EXTENSION

[76] Inventors: Nicholas Bromer; Carol Bromer, both of 6812 Westmoreland Ave., Takoma Park, Md. 20912

[21] Appl. No.: 444,683

[22] Filed: May 19, 1995

[51] Int. Cl.[6] ..... A41D 27/10

[52] U.S. Cl. ..... 2/269; 2/125; 2/85; 2/93

[58] Field of Search ..... 2/270, 269, 85, 2/90, 93, 123, 125, 159, 115, 105, 106

[56] References Cited

U.S. PATENT DOCUMENTS

| | | | |
|---|---|---|---|
| 361,250 | 4/1887 | Wright . | |
| 1,092,047 | 3/1914 | Hertz . | |
| 1,183,792 | 5/1916 | Aron . | |
| 1,328,545 | 1/1920 | O'Shea | 2/270 |
| 1,609,286 | 7/1925 | Bernstein . | |
| 1,643,159 | 2/1927 | Greenberg . | |
| 2,686,913 | 8/1954 | Brierley | 2/270 |
| 2,904,792 | 9/1959 | Elliott . | |
| 2,905,944 | 9/1959 | Stuart et al. | 2/269 |
| 2,928,101 | 3/1960 | Kennedy | 2/270 |
| 3,112,495 | 12/1960 | Johnson . | |
| 3,416,518 | 9/1966 | Samuels et al. . | |
| 4,543,670 | 10/1985 | Ehring | 2/85 |
| 4,569,089 | 2/1986 | Nesse | 2/108 |
| 4,756,077 | 7/1988 | Buenos et al. | 2/123 |
| 5,033,127 | 7/1991 | Schmeltz . | |
| 5,117,507 | 6/1992 | Long | 2/158 |

FOREIGN PATENT DOCUMENTS

| | | | |
|---|---|---|---|
| 488948 | 6/1992 | European Pat. Off. | 2/269 |
| 6136601 | 5/1994 | Japan | 2/69 |

OTHER PUBLICATIONS

Futuro brochure (No date).

*Primary Examiner*—C. D. Crowder
*Assistant Examiner*—Gloria Hale

[57] ABSTRACT

A coat sleeve includes a cuff that folds down to cover the palm portion of the hand. The cuff is held in place over the palm by constrictions about the wrist and knuckles. The constrictions include means for snugging and loosening (elastic and/or fasteners such as snaps, buttons, or VELCRO). The fingers extend from the sleeve end and the thumb extends through a thumb hole disposed between the wrist and knuckle constrictions. In one embodiment the thumb hole connects to the sleeve end and the knuckle constriction acts as a closure for the thumb hole and for the cuff.

17 Claims, 2 Drawing Sheets

COAT SLEEVE CUFF EXTENSION

FIELD OF THE INVENTION

The present invention relates to coats and similar garments intended for protection from cold, and having sleeve ends convertible between different lengths.

BACKGROUND OF THE INVENTION

Sleeves of thermal-protection garments such as coats or jackets generally end at the wrist, leaving the hands and fingers unprotected from cold, requiring gloves or mittens.

Gloves have the disadvantages of needing to be carried separately from the coat and so frequently being lost; this can be a serious problem for wilderness or outdoor users and a great nuisance for the parents of small children. Numerous systems for preventing glove loss have been developed, such as a string attached to either glove and looped around the neck, clips or buttons removably attaching the gloves to the sleeves, and so on. All these have their drawbacks.

Another disadvantage of mittens and gloves is loss of dexterity, requiring repeated cycles of removal for work and replacement to keep the hands warm. Fingerless gloves address this problem by keeping the hand proper covered while leaving the fingers, or some portion of the fingers, uncovered for work.

People without gloves often pull their coat sleeve ends down over their hands or curl their fingers up into the sleeve, but this prevents all use of the hands and requires constant gripping of the sleeve ends, which normally reach to the wrist. If the sleeves are extra long, they can be folded back or unfolded and extended to cover the hands; however, prior-art sleeves have not been designed for this use and so they have no means for securing the sleeve into the folded-back position or for securing the extended sleeve onto the hand.

Several garments known in the prior art show sleeves of adjustable length.

U.S. Pat. No. 3,112,495 to Armigene Johnson shows a sleeve with buttons and buttonholes that hold it in two positions, extended and folded back. The entire cuff folds as one unit about a single fold onto the outside of the sleeve. It is intended for a fashion garment and does not cover the hand when extended.

Adjustable-length sleeve hems are disclosed in U.S. Pat. No. 1,643,159 to Samuel Greenberg. U.S. Pat. No. 5,208,920 to Schaefer et al. is similar.

Several patents disclose mittens or gloves which are attached to a sleeve and which can be folded or otherwise attached out of the way.

U.S. Pat. No. 1,183,792 to Abraham Aron discloses a convertible mitten, a single side of which is attached to the "outer breadth" of a sleeve (page 1, lines 45–49), that is, on one side only; the inner portion 15 is unattached, as seen in FIG. 5 and described at page 1, line 68. The mitten and sleeve are separate pieces, attached at one point. The mitten folds over the outside of the sleeve and is held there by snaps and studs (eg., 24, 25). The thumb is held separately. Like the Wright mitten, the Aron mitten has no means for securing the mitten to the hand. The Aron mitten is a doubly-folded and externally-stored device, making it both bulky and unsightly.

George Wright, in U.S. Pat. No. 361,250, shows a combined mitten and sleeve generally resembling the Aron device except that the mitten folds inside the sleeve instead of over the outside. The sleeve-glove attachment is again on one side only. The Wright device includes a flap d that is loosened and re-fastened when converting from sleeve to mitten configurations (page 1, lines 70–84). The Wright mitten has no means for securing the mitten to the hand, so that the hand will pull out when the wearer shrugs; this makes it impractical for all but the most clumsy work. The Wright mitten is a single-folded, internally-stored device.

U.S. Pat. No. 1,092,047 to Herman Hertz shows a mitten folding over the outside of a sleeve end. It is much like the Wright and Aron devices. It is a triple-fold device (see FIG. 2).

U.S. Pat. No. 4,756,027, issued to Buenos et al., shows a sleeve that folds over to convert to a glove or mitten, covering the fingers. As seen in FIGS. 2 and 3, the cuff includes a conventional hollow thumb piece 21, and the cuff is attached only around half the sleeve. FIGS. 2 and 5 show the same embodiment; as seen in these figures, the lower side of the sleeve (ending at 17) does not fold between the glove and non-glove positions and only the upper side is moved in converting.

Some patents disclose convertible cuffs.

Marla Long, in U.S. Pat. No. 5,117,507, discloses animal puppet sleeves. Long's FIG. 11 shows a retractable (zero-fold) cuff combined with non-folding extensions forming a puppet structure. Long discloses a knitted cuff of the usual type which is folded inwardly when the puppet sleeve parts are used. This cuff does not cover the hand, only the wrist, as shown in FIGS. 10, 12, and 14.

U.S. Pat. No. 1,609,286 to Louis Bernstein describes a cup-like sleeve end covering that is attached to the sleeve; in the uncovered position is surrounds the coat sleeve and in the covered position it closes the end of the sleeve so that the fingers or thumb are trapped within.

U.S. Pat. Nos. 4,631,753 and 4,543,670 to Carolyn Ehring show sleeve attachments for multilayer protective (fire fighters') coats.

Some patents show arm coverings that cover a portion of the hand.

Bessie Samuels and Edith Long, in U.S. Pat. No. 3,416,518, disclose (FIG. 1) a cast cover of elastic stretch fabric having a thumb hole 16. The thumb hole is surrounded by an elastic edge 17.

U.S. Pat. No. 2,904,792 to Robert Elliot shows a protective arm covering for working on engines. It is much like the Samuels et al. cast cover, having a thumb hole 8. The Elliot protective device is not elastic. It has a variable diameter and longitudinal lacing.

FUTURO brochure shows a wrist brace attached by VELCRO proximal the thumb over the wrist and also distal the thumb over the palm.

Other U.S. Pat. Nos. are 7,759; 5,033,127; 2,791,777; 5,308,275; and 4,297,746.

The problem of covering the hand when a user has a jacket, but does not have gloves or mittens, has not been satisfactorily solved by prior art coat sleeves. Prior-art coat sleeve hand-covering extensions have been awkward, bulky when folded, complex in construction and use, and hindering of finger movement. The worst failing of the prior-art attempts to solve this problem is that these known sleeves extensions or sleeve-attached gloves cannot be held in a fixed position on the hand, because they lack any means for holding the sleeve in position; the sleeve can move up and down the arm, making the prior art coats practically useless if the hands need to be used for any but the roughest work.

The prior art does not disclose any coat sleeve extension which is held in position on the hand by any means whatever; in particular, it does not disclose any sleeve portion held in position on the hand by a constrictions around the wrist or about the knuckles.

The prior art does not disclose any coat sleeve that selectively covers and uncovers the palm region of the hand but does not selectively cover and uncover the thumb or the fingers.

The prior art does not disclose any coat sleeve extension which helps to keep gloves on hands while allowing the full dexterity possible with the gloves.

OBJECTS AND SUMMARY OF THE INVENTION

Accordingly, a primary object of the invention is a coat sleeve extension which is secured to the wrist and hand such that, when the arm is moved about, the end of the sleeve is held securely and does not substantially slide up and down the arm.

A second object is a coat sleeve extension which selectively covers the palm of the hand for added thermal protection while leaving the fingers free for dexterity.

Another object is a sleeve extension which aids in retaining separate gloves or mittens on the hands.

Still another object is to provide thermal insulation for the hand that is attached to a coat and so cannot be lost.

The present invention relates to a cuff or sleeve extension which is selectively foldable between a palm-covering position and a folded-back, forearm-covering position.

The sleeve includes a wrist constriction and a knuckle constriction, each capable of being selectively opened or loosened to allow the hand to pull through and snugged or fastened closed to hold the sleeve securely about the wrist and the knuckles, respectively. For selective snugging and distending the constrictions are adjustable in circumference. The preferred means for adjustment are elastic, fasteners, or a combination of these.

Intermediate the wrist and knuckle constrictions is a thumb hole through which the thumb protrudes when the cuff is in the palm-covering position. When the cuff is folded down and the two constrictions are snugged, the fingers and thumb extend outward from the cuff end and the thumb hole respectively.

The most distal end of the cuff may include a longitudinal slit extending from the cuff end to the thumb hole, the slit being closed by fasteners.

In one embodiment the two constrictions constitute a cuff having a single band of elastic material with a thumb slit between them.

Means for holding up the cuff in the folded-back position may be included in the invention.

The present invention meets the objects by being held securely in position on the hand by the two constrictions; being selectively foldable up to uncover and down to cover the palm of the hand; being permanently attached to the coat sleeve; and being able to fold down and be secured over separate gloves.

BRIEF DESCRIPTION OF THE DRAWING FIGURES

DETAILED DESCRIPTION OF THE PREFERRED EMBODIMENTS

Here, and in the following claims:

anatomical terms such as "metacarpals", "carpals", and phalanges", "proximal" and "distal" have their usual meanings;

"coat" means a coat, jacket, windbreaker, parka, overcoat, raincoat, sweater, or any other torso-covering garment having long sleeves and used either primarily for thermal insulation or incidentally for thermal insulation (eg., a raincoat);

"hand" means the portion of the upper extremity distal the wrist (carpal bones), including the palm and fingers;

"knuckles" means the hand in the area around the joint between metacarpals and the phalanges, including the palm between the thumb and the first joint of the phalanges, and refers to either the back side of the hand or the front side (front being the side toward which the fingers curl);

"means for folding" a garment or garment portion includes fold lines defined by stitching or edges of layers of material, and also includes the garment being made of fabric or other material which is pliable enough to folded over itself by a half turn (i.e., about 180 degrees);

"palm" means the hand generally exclusive of the fingers (phalanges); it includes the knuckles (the region that includes the joints between the metacarpals and the phalanges) and the back side of the hand as well as the front side (front being the side toward which the fingers curl);

"palm front" or "front palm" means the inside of the palm, on the side toward which the fingers curl.

Figure 1:
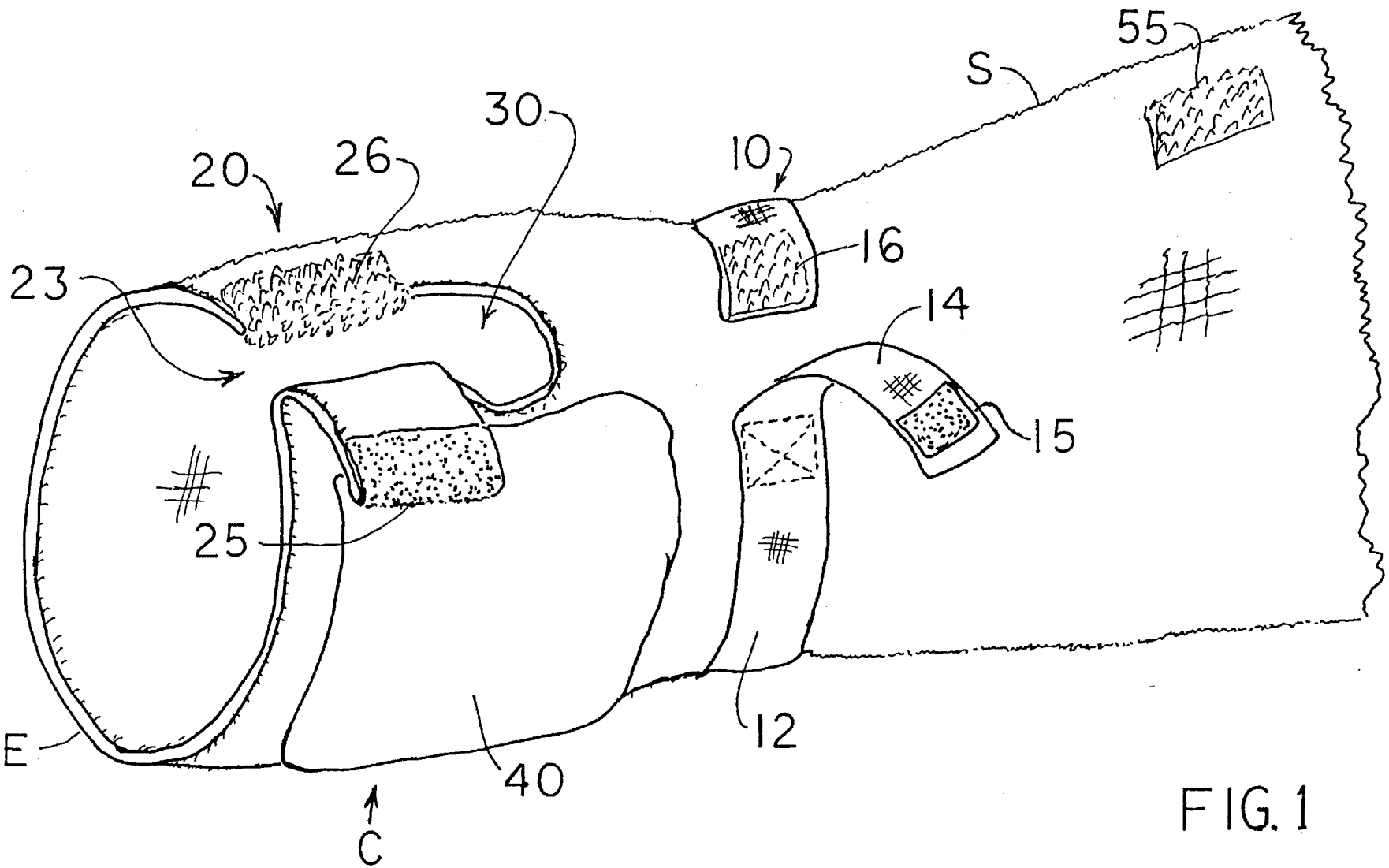
FIG. 1 is a perspective view of a first preferred embodiment of the present invention.

A first preferred embodiment of the present invention is shown in FIG. 1. The distal end of a coat sleeve S includes a first constriction 10 to encircle the wrist of a user (not shown) and a second constriction 20 to be disposed about the knuckles of the user (not shown). The invention may optionally include third or fourth constrictions (not shown). The illustrated cuff is for the user's right hand. The sleeve of FIG. 1 may be made of any conventional coat material or combination of materials, for example, polyester fleece.

Each of the constrictions 10, 20 includes means for selectively opening or distending and closing or snugging that constriction. When opened, each constriction has a circumference or girth sufficient to allow the user's hand (not shown) to pass through. The wrist constriction 10, when snugged, has a girth small enough to prevent the hand from passing through but large enough not to bind the wrist about which it is snugged. The knuckle constriction 20, when snugged, has a girth small enough to encircle the palm closely but large enough not to bind the knuckles.

In the embodiment illustrated in FIG. 1 the wrist constriction 10 includes a elasticized band 12 and a fastener consisting of a strap 14, hook material 15, and loop material 16. (An example of hook-and-loop fastener material is VELCRO.) Either elastic alone or a fastener alone could be used. The fastener can be hook-and-loop, snaps, buttons, zippers or any other conventional type. The wrist constriction may alternatively use only elastic and omit the fastener 14–16.

The knuckle constriction 20 illustrated in FIG. 1 may optionally include a slit or opening 23. If so, it will also include fasteners 25 and 26, and/or elastic material near the hem or end E of the cuff.

The slit 23 continues in the proximal direction and is continuous with a thumb hole 30, through which the user's thumb (not shown) protrudes when the cuff is in the extended position that is illustrated in FIG. 1. The thumb hole 30 may also be disconnected from the slit 23, standing alone; it will of course also stand alone if there is no slit 23. The thumb hole 30 need not be circular, but may be of any shape that will comfortably allow the user's thumb to extend through it.

The illustrated cuff of FIG. 1 includes a palm patch 40 which is adhered, sewed, or otherwise fastened to the front palm portion of the cuff. The patch 40 may be of rubberized material, leather, heavy fabric, or other stuff which improves the abrasion resistance, gripping friction, warmth, moisture resistance, or other qualities desired for the front palm area of the cuff. The patch 40 may also stiffen the cuff C, thereby acting as a means for holding it in the folded-back position.

The un-numbered flap (actually part of the cuff C), on which the fastening material 25 is sewed, is preferably disposed on the back side of the palm portion of the hand when the constriction 20 is snugged or fastened, so that the fastener is not located under the user's palm where it could cause irritation, get in the way, or be accidentally opened by handled objects.

When the cuff C is folded over the sleeve S into the folded position (not shown) a hold-up 55 may be provided to prevent the cuff from falling down into the (illustrated) extended position. The hold-up 55 shown is a patch of hook material which is sewn to the sleeve S in such a position that it adheres to the loop material 25 (which covers both sides of the cuff). To secure the cuff, the user folds it up, fastens the loop material 25 to the hook material 26, moves the cuff C into the folded-back position, and fastens the opposing side of the loop material 25 to the hold-up 55.

Preferably, the hold-up interacts with fasteners of the knuckle constriction (if there are any). Otherwise, the hold-up may include fasteners on the sleeve portion and the end of the cuff portion.

The present invention does not restrict the widths of the first and second constrictions. These constrictions may be widened, while their edges at the wrist and knuckles remain in place, until their adjacent edges come close together, and, in the limit, meet. The invention thus also includes widened first and second a single constrictions which abut; this is the second preferred embodiment of the present invention, shown in FIG. 2. (Alternatively, the embodiment of FIG. 2 may be considered as including an additional constriction intermediate the wrist and knuckle constriction.)

Figure 2:
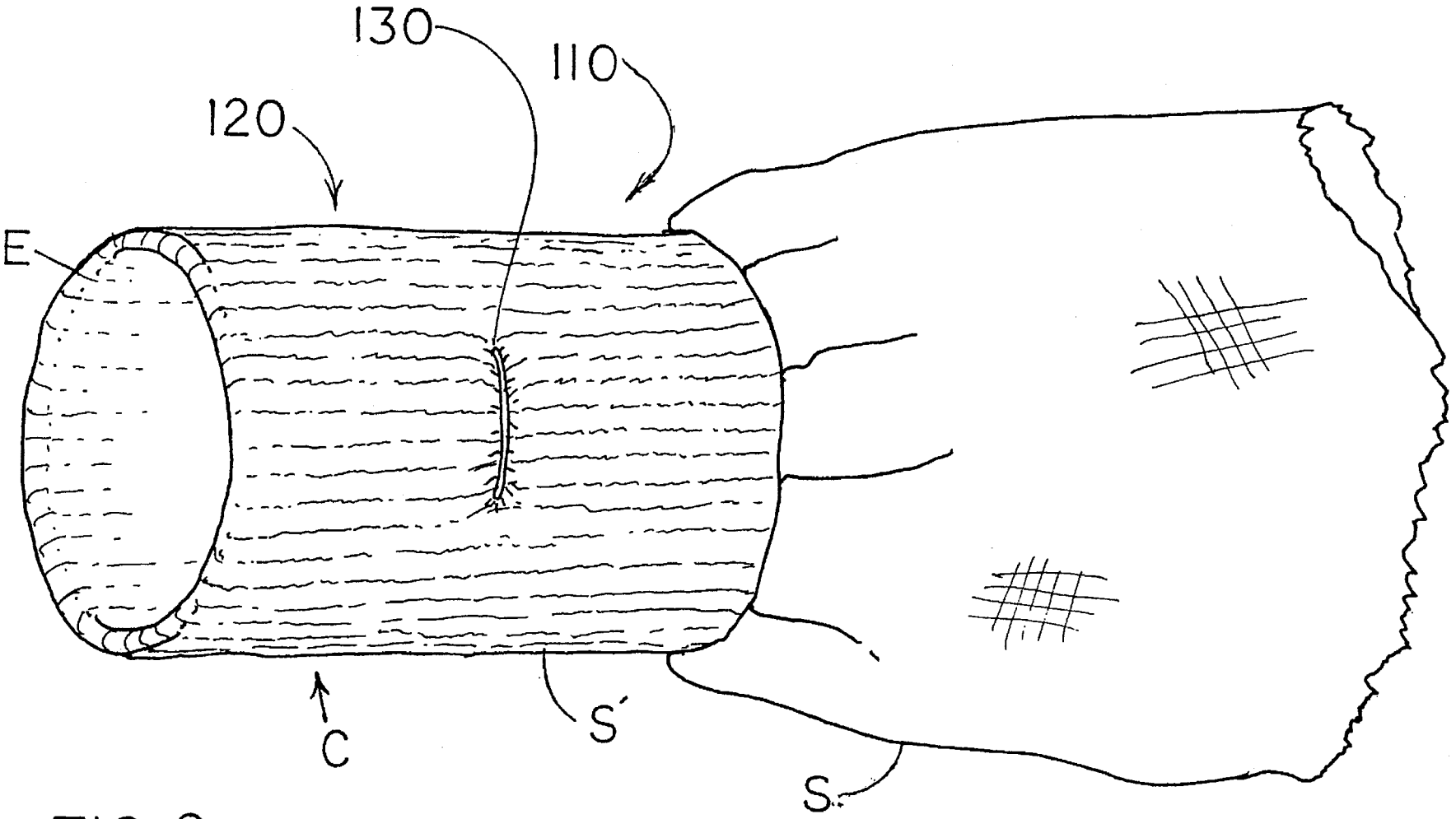
FIG. 2 is a perspective view of a second preferred embodiment of the present invention.

FIG. 2 depicts a longitudinally continuous tube of elasticized material, such as for example knit tube material, divided into the wrist constriction 110 and the knuckle constriction 120 by a thumb hole 130. The preferred form of the hole 130 is the transverse slit shown.

The arm-covering portion of the sleeve in this embodiment includes an upper sleeve S and a knit sleeve S,' which includes the wrist constraint 110. The more distal portion of the knit tube may be denoted as the cuff C, which can be folded back onto the sleeve portion S' when not in the extended position.

The thumb hole 130 is preferably located at a point that is substantially mid-way between the distal end of the sleeve S and the end E of the cuff (the most distal part of the cuff C), so that the slit becomes part of the fold line when the cuff C is rolled back into the folded position and the cuff C then substantially covers the sleeve S'. However, the thumb hole 130 may be of any shape and be located toward either end of the knit tube. For comfort, the hole 130 should be located in a generally forward position relative to the coat, that is, it should be placed angularly about the sleeve so that it corresponds with the thumb's natural position when the forearm is relaxed and not rotated.

If a knit tube is used for the second preferred embodiment, the friction of the material may be sufficiently great so that no hold-up is required to prevent the cuff from falling down. Accordingly, none is shown in FIG. 2, but it is understood that a hold-up may be used in this embodiment as well as in the embodiment of FIG. 1.

The present invention has the great advantage over prior-art garments that its palm-covering portion or cuff is firmly held onto the hand by the two constraints and so stays in its proper position on the hand. Because the constraints are releasable, the garment of the present invention is easily converted from folded to extended positions.

The present invention may be used in several ways. In cool weather it provides enough hand insulation so that gloves are not needed, and does not hinder dexterity; in colder temperatures, it may be used in conjunction with gloves or mittens worn either inside or outside of the extended cuff, and again allows for more dexterity by keeping the hands warm with lighter gloves. For wilderness use, the invention provides some safety in case of glove loss, and as the entire sleeve is long when the cuff is down, the fingers and thumb are easily curled into a fist and held inside. For small children, it will retain gloves or mittens worn inside the extended cuffs and prevent loss. Very young children will not be able to remove their gloves when the sleeves of the present invention are fastened over them, but parents will be able to remove the gloves easily.

The invention is not limited to the preferred embodiments disclosed above, but includes all within the scope of the claims.

We claim:

1. In a thermal-protection coat for covering selectively a user's torso, arm, wrist, palm, and knuckles, the coat having a torso portion and a sleeve, the improvement wherein the sleeve comprises:

a cuff portion distal the torso portion;

an arm portion intermediate the cuff portion and the torso portion;

means for folding the cuff portion between an extended position, wherein the cuff portion and the arm portion have a generally tube-like configuration encircling the palm, and a folded-back position, wherein the cuff portion encircles the arm portion;

wrist constriction means for selectively distending and snugging the sleeve about the wrist of the user, the wrist constriction means being intermediate the arm portion and the cuff portion;

knuckle constriction means for selectively distending and snugging the sleeve about the palm of the user, the knuckle constriction means being disposed adjacent an end of the cuff distal the wrist constriction means; and a thumb opening disposed between the wrist constriction means and the knuckle constriction means and between a front palm portion of the cuff and a back palm portion of the cuff, for a thumb of the user to extend outside of the sleeve;

whereby the cuff portion may in the folded-back position uncover the palm of the user and may in the extended position be held over the palm by the wrist constriction and the knuckle constriction so as to warm the palm.

2. The improvement according to claim 1, wherein the cuff portion includes a fro palm patch located between the wrist constriction and the knuckle constriction and adjacent the thumb opening.

3. The improvement according to claim 1, wherein the wrist constriction means for selectively opening and closing the sleeve about the wrist of the user includes a fastener.

4. The improvement according to claim 3, wherein the fastener is selected from the group consisting of snaps, buttons, hook-and-loop materials, zippers, and drawcords.

5. The improvement according to claim 1, wherein the wrist constriction means includes elastic material at least partially encircling the sleeve.

6. The improvement according to claim 1, wherein the knuckle constriction means for selectively opening and closing the sleeve about the palm of the user includes a fastener.

7. The improvement according to claim 6, wherein the fastener is selected from the group consisting of snaps, buttons, hook-and-loop materials, zippers, and drawcords.

8. The improvement according to claim 1, wherein the knuckle constriction means includes elastic material at least partially encircling the sleeve.

9. The improvement according to claim 1, further including hold-up means for holding the cuff portion in the folded-back position.

10. The improvement according to claim 9, wherein the hold-up means includes a fastener.

11. The improvement according to claim 10, wherein the fastener is selected from the group consisting of snaps, buttons, and hook-and-loop materials.

12. The improvement according to claim 1, wherein the coat includes a coat front side and a coat back side, the sleeve includes a corresponding sleeve front side and a sleeve back side, and wherein the thumb opening is located, about a circumference of the sleeve, adjacent to a midpoint of the sleeve front side.

13. The improvement according to claim 1, wherein the wrist constriction means includes a first length of generally tubular elastic material, the knuckle constriction means includes a second length of generally tubular elastic material, and the first length abuts the second length.

14. The improvement according to claim 13, wherein the first length and the second length form a single length of tubular elastic material.

15. The improvement according to claim 14, wherein the thumb opening includes a slit extending transversely across the single length.

16. The improvement according to claim 14, wherein the thumb opening is located substantially at a midpoint of the single length.

17. The improvement according to claim 1, including a slit extending from the thumb hole to the end of the cuff, and wherein the knuckle constriction includes a fastener for closing the end of the cuff by joining the sides of the slit.

* * * * *